US007962998B2

(12) United States Patent
Proctor et al.

(10) Patent No.: US 7,962,998 B2
(45) Date of Patent: Jun. 21, 2011

(54) ROLLER SUPPORT ASSEMBLIES

(75) Inventors: Nigel Proctor, Preston (AU); Paolo Lazzarin, Vermont (AU); Derek Jefferson, Hillside (AU)

(73) Assignee: Anthony Innovations Pty, Ltd, Victoria (AU)

( * ) Notice: Subject to any disclaimer, the term of this patent is extended or adjusted under 35 U.S.C. 154(b) by 352 days.

(21) Appl. No.: 11/860,317

(22) Filed: Sep. 24, 2007

(65) Prior Publication Data

US 2009/0077766 A1 Mar. 26, 2009

(51) Int. Cl.
*A47H 15/00* (2006.01)

(52) U.S. Cl. ..... 16/97; 16/106; 16/107; 16/40; 16/18 CG

(58) Field of Classification Search ..... 16/97–107, 16/90, 91, 87 R, 18 R, 18 CG, 40, 41
See application file for complete search history.

(56) References Cited

U.S. PATENT DOCUMENTS 114,731 A * 5/1871 Waitt ..... 16/100
205,906 A * 7/1878 Rider ..... 16/98
809,695 A * 1/1906 Keil ..... 16/100
1,647,610 A * 11/1927 Crum ..... 16/97
4,262,451 A * 4/1981 Dallaire ..... 16/99
5,568,671 A * 10/1996 Harris et al. ..... 16/18 R
6,434,789 B1 * 8/2002 Kruse ..... 16/93 R

FOREIGN PATENT DOCUMENTS

AU 779340 * 12/2001

* cited by examiner

*Primary Examiner* — Victor Batson
*Assistant Examiner* — Jeffrey O'Brien
(74) *Attorney, Agent, or Firm* — Miller Law Group, PLLC

(57) ABSTRACT

A roller support assembly is used to support sliding doors, windows or the like. The assembly includes a housing member having spaced apart side walls and interconnecting transverse walls defining a roller receiving zone for receiving and operationally mounting a roller assembly. The roller assembly has a roller body with a rolling peripheral rim and a shaft whereby the roller body is rotatable relative to the shaft having short stub axle parts. The housing side walls including openings that are fully enclosed by the side walls into which the short stub axle parts fit. The housing side walls further include projecting elements extending inwardly from an inner surface of a housing side wall to cooperate with the corresponding roller body side wall surfaces to spay the housing side walls apart as the roller assembly is moved into the roller receiving zone to locate the stub axle parts in the openings.

13 Claims, 2 Drawing Sheets

Fig. 1
Prior Art
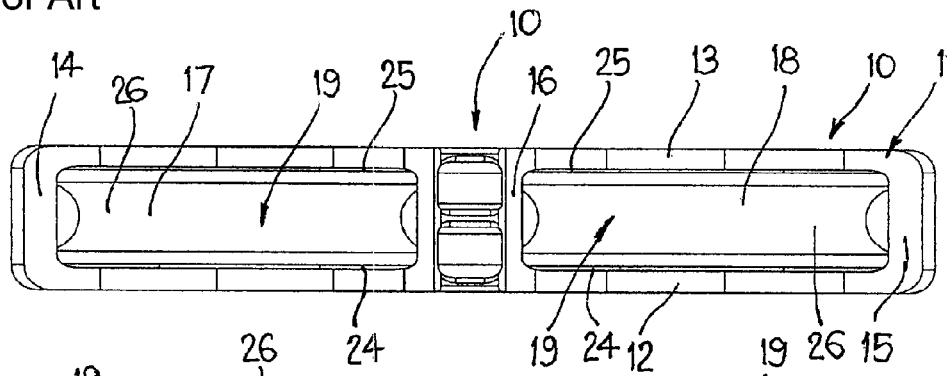
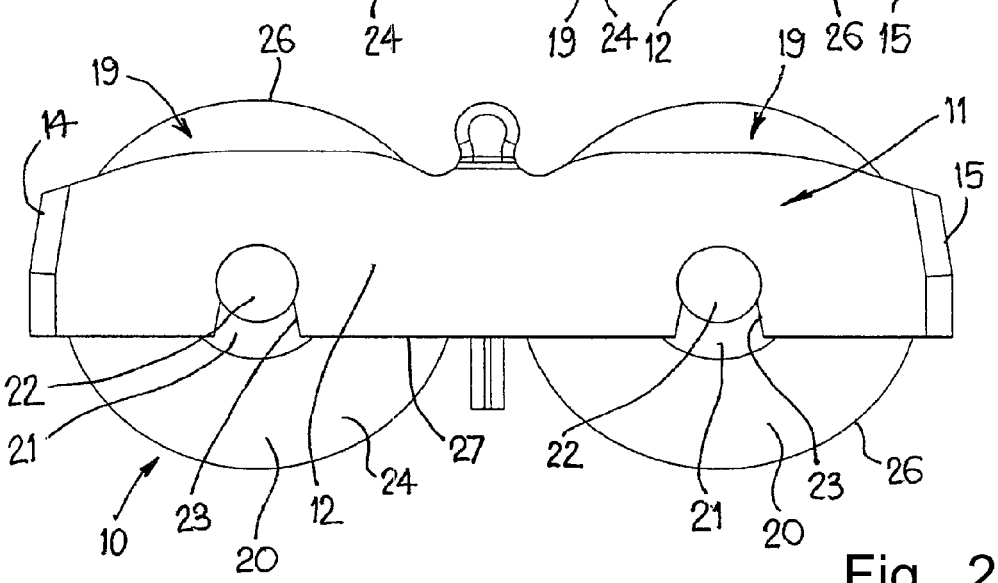
Fig. 2
Prior Art
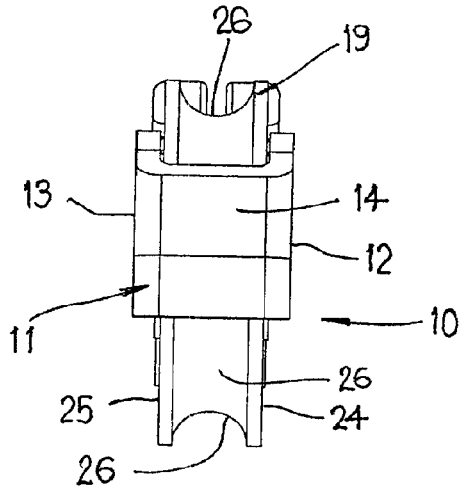
Fig. 3
Prior Art Fig. 4
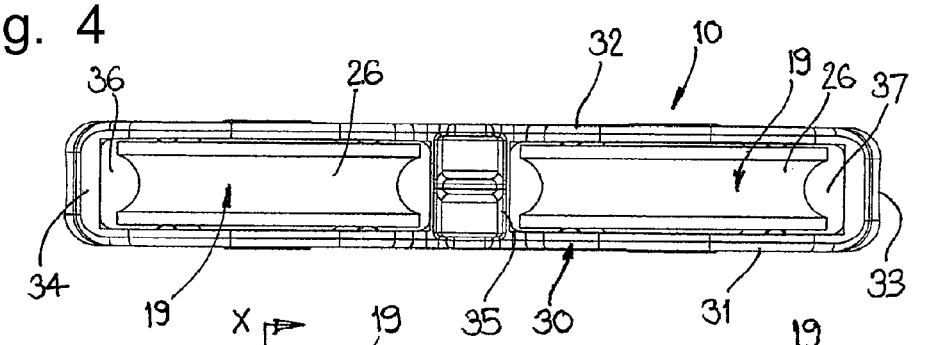
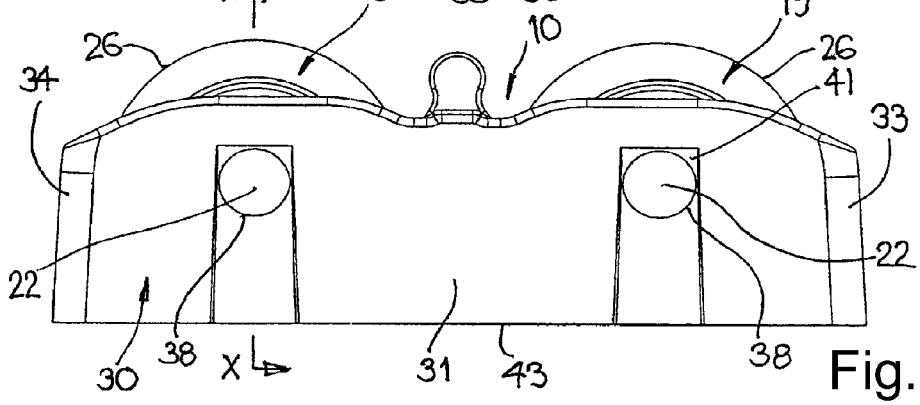
Fig. 5
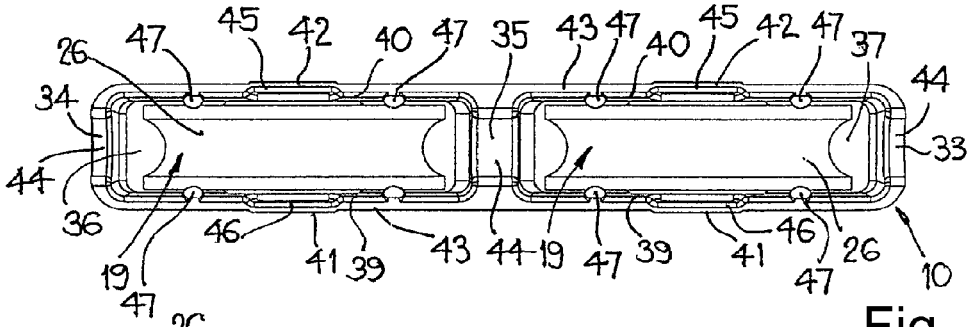
Fig. 6
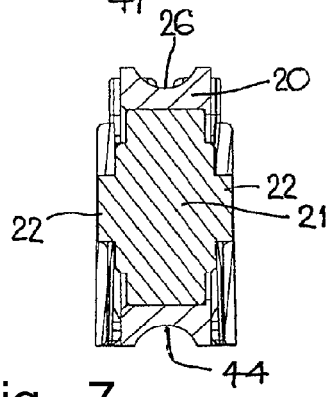
Fig. 7
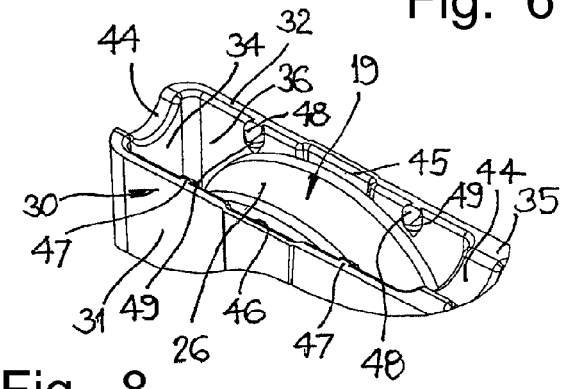
Fig. 8

ROLLER SUPPORT ASSEMBLIES

FIELD OF THE INVENTION

The present invention relates to roller support assemblies or structures for supporting sliding doors, windows or the like.

BACKGROUND OF THE INVENTION

Commonly rollers used in support structures have a roller body with a peripheral formed rim adapted in use to engage a linear guide track to roll there along. The rollers commonly include an axially extending shaft with suitable bearing means to allow the roller body to freely rotate about a rotation axis defined by the shaft with the shaft having short axially extending stub shaft parts extending outwardly of side walls of the roller body. The short stub shaft parts are adapted to engage and be retained in a downwardly open retainer recess in side walls of a housing part of some form, the minimum dimension of the recess being slightly less than that of the stub shaft parts such that the stub shaft parts will, when being assembled snap fit into the retainer recess and be held thereby.

Typically, the shafts including the extending stub shaft parts will be a suitable metal and the housing part may be made from molded plastics material. Such a configuration is shown, for example, in the specification of Australian Patent No. 779340. In this specification the roller support assembly comprises an outer housing part adapted to be secured in a downwardly facing recess of a door, window or similar sliding panel. The outer housing part includes an inner support carriage carried by the outer housing part and adjustable in height relative to the outer housing part. The inner support carriage itself carries a bogie member in releasable manner that carries one or more rollers fitted between side walls of the bogie member in a manner as described in the foregoing.

While such assemblies have worked satisfactorily, the downwardly open retainer recesses in the side walls of the bogie member provide a degree of weakness and therefore greater flexibility for the side walls that are made from molded plastics material, which can cause difficulties and lower service life when under reasonably heavy loads. A further practical difficulty is that in roller support assemblies as described, the peripheral formed rim of the roller (or rollers) extends below the lower edge of the door or other panel in which it has been installed. There is then a risk that the door or other panel will, during installation and before the roller is correctly engaged with the linear guide track on which it is intended to roll, will be supported on the roller peripheral rim and possibly dragged across surfaces transverse to the peripheral rim. Given that the roller body and the formed peripheral rim are commonly also made from molded plastics material, such actions during installation have a significant risk of causing damage to the peripheral rim of the roller.

SUMMARY OF THE INVENTION

The objective of the present invention is to provide a roller support assembly that will improve performance of the assembly once installed and preferably minimize or prevent damage to the roller during installation.

Accordingly, the present invention provides a roller support assembly having a housing member having spaced apart side walls defining a roller receiving zone therebetween, a roller operationally supported in said roller receiving zone, said roller including a roller body, a shaft supporting said roller body for rotation relative to said shaft, and said shaft including stub shaft parts extending laterally from opposed side wall surfaces of said roller body, each said housing side wall having a fully enclosed opening for receiving a said stub shaft part when the roller is installed in said roller receiving zone, at least one of said housing side walls or said roller body side wall surfaces having a formation cooperable with the other as a said roller is moved into said roller receiving zone to relatively splay the housing side walls apart until said stub shaft parts engage in a respective said opening, said formation or formations not interfering with rotation of the roller body once the roller is located in an installed position in said roller receiving zone.

Conveniently the formation or formations may include at least one inwardly projecting element on at least one of said housing side walls, the or each said projecting element being engageable with a side wall surface of the roller body as the roller is moved towards said installed position. Each of the openings may be an aperture extending fully through a housing side wall or it may be a blind recess that does not open onto the outer surface of the housing side wall. Conveniently, the or each said projecting element is spaced from the roller when said stub shaft parts are respectively operationally engaged in a said opening in said installed position. Preferably one or both housing side walls may include two said projecting elements spaced from one another on opposite sides of the shaft of the roller.

In a preferred arrangement each of the housing side walls has a lower most edge spaced below said opening, each said housing side wall further including a groove formed in an inwardly facing surface, said groove extending from said lower most edge to said opening. Conveniently each said housing side wall has a lower most edge spaced below said opening, said lower most edge being located at or below the lower most extremity of said roller.

In a further preferred embodiment at least one housing transverse wall extends between said housing side walls to partly define said roller receiving zone, the or each said transverse wall having a transverse wall lower most edge continuous with the lower most edges of the housing side walls, the transverse wall lower most edge having an upwardly extending recessed region relative to the lower most edges of the housing side walls. Conveniently, at least one transverse wall is provided extending between said housing side walls to partly define said roller receiving zone, the or each said housing transverse wall having a transverse wall lower most edge region spaced upwardly relative to the lower most edges of the housing side walls.

Preferably the housing member may have two said housing side walls and three said housing transverse walls, two of said housing transverse walls forming opposed end walls of the housing member and a third said housing transverse wall being located intermediate said end walls whereby two said roller receiving zones are formed, each of said roller receiving zones carrying a said roller.

It will be apparent from the foregoing that the roller support assembly provided according to this invention will have stronger and less flexible housing side walls as the side walls are not partially weakened by a rear opening into the lower edge of the housing to permit the roller to be installed therewith.

In accordance with a second aspect of this invention, there is provided a roller support assembly having a housing member having spaced apart housing side walls defining a roller receiving zone therebetween, a roller operationally supported in said roller receiving zone, said roller including a roller body, a shaft supporting said roller body for rotation relative to said shaft, and said shaft including stub shaft parts extending laterally from opposed side wall surfaces of said roller body, each said housing side wall having an opening for receiving and retaining a said stub shaft part when the roller is installed in said roller receiving zone, said housing member further including at least one transverse wall extending between said housing side walls, each of said side walls and the or each transverse wall having lower edge zones such that at least the lower edge zones of the housing side walls are arranged at or below a lower most extremity of said roller when the roller is installed in said roller receiving zone, and the lower edge zone of the or each said transverse wall being spaced upwardly from said lower edge zones of the housing side walls. In this embodiment the opening in the side walls of the housing might either be a fully enclosed opening or a recess opening onto the lower most edge of the side walls. In this second aspect, the provision of the side wall edge zones being extended to a position equal to or lower than the lower most extremity of the roller protects the roller during the installation process.

In accordance with a further aspect of this invention there is also provided a method of installing a roller in a roller support assembly having a housing member having spaced apart housing side walls defining a roller receiving zone therebetween, said roller including a roller body, a shaft supporting said roller body for rotation relative to said shaft with stub shaft parts extending laterally from opposed side wall surfaces of said roller body, each said housing side wall including a fully enclosed opening for receiving and retaining a said stub shaft part when the roller is installed in said roller receiving zone, at least one of said housing side walls or the side wall surfaces of the roller body having an inwardly projecting formation, said method including moving a said roller into said roller receiving zone whereby the formation or formations on at least one side wall surface of the roller body or the housing side walls interengage to relatively splay the housing side walls until the stub shaft parts are engaged in a said opening.

Further preferred features and aspects of the present invention will become apparent from the following description given in relation to the accompanying drawings.

BRIEF DESCRIPTION OF THE DRAWINGS

FIG. 1 is a top plan view of a roller support assembly according to a prior art arrangement;

FIG. 2 is a side elevation view of the prior art roller support assembly shown in FIG. 1;

FIG. 3 is an end elevation view of the prior art roller support assembly shown in FIG. 1;

FIG. 4 is a top plan view of a roller support assembly according to a preferred embodiment of the present invention;

FIG. 5 is a side elevational view of the embodiment shown in FIG. 4;

FIG. 6 is an underneath plan view of the embodiment shown in FIG. 4;

FIG. 7 is a cross-sectional view taken along line X-X of FIG. 4; and

FIG. 8 is a partial underneath perspective view of the embodiment shown in FIGS. 4 to 7.

DETAILED DESCRIPTION OF THE PREFERRED EMBODIMENT

Referring first to FIGS. 1 to 3, there is shown a bogie arrangement 10 usable in a roller support assembly of the general type described and illustrated in Australian Patent Specification No. 779340. The prior art assembly comprises a housing member 11 with a pair of spaced side walls 12, 13, a pair of transverse end walls 14, 15 integrally formed with and interconnecting the side walls 12, 13 and an intermediate transverse wall 16 dividing the space within the housing member 11 into two roller receiving zones 17, 18, each having a roller assembly 19 mounted therein. Each roller assembly 19 includes a roller body 20, a shaft 21 with stub shaft parts 22 extending laterally from side faces 24, 25 of the roller body 20. The roller body has a peripheral rim 26 formed as a groove so as to be cooperable, in use, with a linear guide track (not shown). The roller body 20 is rotationally mounted on the shaft 21 and each roller assembly 19 is secured to the housing member 11 by snap fitting the stub shaft parts 22 into a recess 23 opening into a lower edge zone 27 of the housing member 11. As can be readily seen the lower most regions of the roller bodies 20 extend well below the lower most edge zone 27 of the housing member 11. Typically the roller body 20 and the housing member 11 are produced from molded plastic material whereas the shaft 21 including the stub shafts 22 may be manufactured from a suitable metal.

Referring now to FIGS. 4 to 8, one preferred embodiment of the present invention is illustrated. In this embodiment, each of the two roller assemblies 19 may be constructed similarly to that which is shown in FIGS. 1 to 3 and like features have been given the same reference numbers. The housing member 30 has two spaced side walls 31, 32, two spaced end walls 33, 34 integrally formed with and interconnecting the side walls 31, 32, and an intermediate wall 35. The side walls 31, 32 and the transverse walls 31, 32 and 35 divide the internal space within the housing member 30 into two spaced roller receiving zones 36, 37, each receiving and operationally retaining a roller assembly 19. Each side walls 31, 32 has a fully enclosed circular aperture 38 extending completely through the respective side wall 31, 32. It should, however be recognized that the apertures 38 could also be formed as a blind recess that does not fully extend through the side wall 31, 32 from the inside side wall surfaces 39, 40 to the outside side wall surfaces 41, 42.

Each side wall 31, 32 has a lower most edge zone 43 that is positioned at or below the lower most regions of the roller body 20 so that the peripheral rim 26 of the wheel bodies 20 are, at least below the shaft 21, fully within the roller receiving zones 36 or 37. It is preferred that the lower most edge zones 43 of each housing side wall 31, 32 is at the same level and in the same plane such that the roller support assembly 10 can stand on an underlying support surface without the roller rim 26 contacting same. As will be seen in FIGS. 7 and 8, the transverse end walls 33, 34 and the transverse intermediate wall 35, each include an upwardly extended recess 44 to accommodate the linear guide rail on which the roller rim surface 26 is, in use, intended to roll. While the recessed zones 44 are preferred, it will be appreciated that in alternative embodiments, the lower edges of the transverse walls might simply be spaced upwardly from the lower most edge zones 43 of the side walls 31, 32.

Preferably, the inwardly facing side wall surfaces 39, 40 of the side walls 31, 32, may include groove formations 45, 46 leading from the lower most edge zone 43 to the aperture 38 to guide the stub shaft parts 22 directly to the aperture 38.

As is best seen in FIGS. 6 and 8, each of the side walls 31, 32, on their inner surfaces 39, 40 include a number of projecting elements 47 extending inwardly of the zones 36, 37. Each projecting element 47 includes an inclined ramp or chamfer 48 leading to a thickened zone 49. Each projecting element 47 is positioned on either side of the grooves 45, 46 and therefore relative to the roller shafts 21, on either side of the shafts 21. The projecting elements 47 are positioned to engage with the outer surfaces 24, 25 of the roller body 20 as the roller assembly is moved upwardly into the zones 36, 37. In doing so, the interference of the projecting elements 47 with the roller surfaces 24, 25, cause the side walls 31, 32 of the housing member 30 to splay outwardly easing movement of the roller assembly 19 into the zone 36 or 37. As the peripheral edge or rim 26 of the roller body 20 clears the projecting elements 47, the stub shaft parts 22 snap into the openings or apertures 38 to reach their installed position.

While the number and positioning of the projecting elements 47 as shown in the annexed drawings is preferred, it will be recognized that other arrangements could be used. The number of the projecting elements 47 could be reduced or possibly be repositioned. If, however the projecting element 47 might remain in the rotation zone of the roller body side wall surfaces 24, 25, then a rotational groove or similar to clear the projecting element 47 positioned in the surface regions 24, 25 might be required so once the roller assembly is in the installed position no interference occurs between the housing member 30 and the roller assembly 19. In a possible further alternative arrangement, the projecting elements 47 might be positioned on the roller body side surfaces 24, 25 and engage with the housing surfaces 39, 40. Again if this option were adopted, the projecting elements 47 would need to, at the installed position, drop into an annular groove in the surfaces 39, 40 so as to again avoid interference in the installed position.

It will be recognized that those skilled in the art that modifications and variations of the preferred embodiments may be made without departing from the concepts defined in the claims annexed hereto. For example, it is preferred that the housing member 30 be made by molding a suitable plastic material, however, it might also be made from casting a suitable metal such as aluminum or an aluminum alloy.

Having thus described the invention, what is claimed is:

1. A roller support assembly comprising an integrally formed housing member having spaced apart side walls joined to spaced apart end walls defining a roller receiving zone therebetween having a neutral use configuration with the side walls substantially parallel to one another, a roller operationally supported in said roller receiving zone, said roller including a roller body, a shaft supporting said roller body for rotation relative to said shaft, and said shaft including stub shaft parts extending laterally from opposed side wall surfaces of said roller body, each said stub shaft part having a continuous peripheral bearing surface, each said housing side wall having an opening with a continuous peripheral bearing surface for receiving and engaging the continuous peripheral bearing surface of one of said stub shaft parts when the roller is located in an installed position in said roller receiving zone, at least one of said housing side walls having at least one formation engageable with one of said roller body side wall surfaces as said roller is moved into said roller receiving zone to relatively move at least one of the housing side walls outwardly from said neutral use configuration until each said formation is free of said roller body and said stub shaft parts engage in a respective said opening, said at least one formation not interfering with rotation of the roller body once the roller is located in said installed position in said roller receiving zone with said stub shaft parts engaged in a respective said enclosed opening.

2. The roller support assembly according to claim 1 wherein each said formation includes at least one inwardly projecting element on at least one of said housing side walls, each respective said projecting element being engageable with a side wall surface of the roller body as the roller is moved towards said installed position.

3. The roller support assembly according to claim 2 wherein each said opening is an aperture extending fully through said housing side wall.

4. The roller support assembly according to claim 2 wherein said at least one projecting element is spaced from a peripheral region of said roller when said stub shaft parts are operationally engaged in the corresponding said opening in said installed position.

5. The roller support assembly according to claim 4 wherein one said housing side wall includes two said projecting elements spaced from one another on opposite sides of the shaft when said roller is in said installed position.

6. The roller support assembly according to claim 5 wherein both said housing side walls include two said projecting elements spaced from one another, the projecting elements on each said side wall being located on opposite sides of the shaft when said roller is in said installed position.

7. The roller support assembly according to claim 1 wherein each said housing side wall has a lower most edge spaced below said opening, each said housing side wall further including a groove formed in an inwardly facing surface of the housing side wall, said groove extending from said lower most edge to said opening.

8. The roller support assembly according to claim 1 wherein each said housing side wall has a lower most edge spaced below said opening, said lower most edge being located at or below a lower most extremity of said roller.

9. The roller support assembly according to claim 8 wherein each said end wall has a lower edge that includes an upwardly extending recessed region relative to the lower most edges of the housing side walls.

10. The roller support assembly according to claim 9 wherein the housing member includes a transverse wall joining said housing side walls intermediate of said end walls, whereby a roller receiving zone is formed between each said end wall and said intermediate transverse wall, each of said roller receiving zones carrying a corresponding said roller, said intermediate transverse wall having a lower edge that includes an upwardly extending recessed region relative to the lowermost edges of the housing side walls.

11. A roller support assembly having an integrally formed housing member having spaced apart housing side walls joined to spaced apart end walls and defining a roller receiving zone therebetween having a neutral use configuration with the side walls substantially parallel to one another, a roller operationally supported in said roller receiving zone, said roller including a roller body, a shaft supporting said roller body for rotation relative to said shaft, and said shaft including stub shaft parts extending laterally from opposed side wall surfaces of said roller body, each said housing side wall having an opening for receiving and retaining one of said stub shaft parts when the roller is located in an installed position in said roller receiving zone, at least one of said housing side walls having at least one formation engagable with one of said roller body side wall surfaces as said roller is moved into said roller receiving zone to relatively move at least one of the housing side walls outwardly from said neutral use configuration until each said formation is free of said roller body and said stub shaft parts engage in a respective said opening, said at least one formation not interfering with rotation of the roller body once the roller is located in said installed position in said roller receiving zone with said stub shaft parts engaged in a respective said opening, each of said side walls and each of said end walls having lower edge zones with at least the lower edge zones of the housing side walls being arranged at or below a lower most extremity of said roller when the roller is in said installed position in said roller receiving zone, and the lower edge zone of said end walls having at least a portion thereof spaced upwardly from said lower edge zones of the housing side walls.

12. The roller support assembly according to claim 11 wherein the opening in each said housing side wall has a continuous peripheral bearing surface for receiving and engaging a continuous peripheral bearing surface of a corresponding said stub shaft part, each said housing side wall including a groove formed in an inwardly facing surface, said groove extending from said lower edge zones of the housing side walls to said openings.

13. The roller support assembly according to claim 11 wherein the housing member includes a transverse wall joining said housing side walls intermediate said end walls whereby a roller receiving zone is formed between each said end wall and said intermediate transverse wall, each of said roller receiving zones carrying a corresponding said roller, said intermediate transverse wall having a lower edge that includes an upwardly extending recessed region relative to the lower edge zones of the housing side walls.

* * * * *